United States Patent [19]

Kaiser

[11] Patent Number: 4,459,438

[45] Date of Patent: Jul. 10, 1984

[54] APPARATUS COMPRISING A TRACK AND ARTICLES FOR MOVEMENT THEREALONG

[76] Inventor: Helmut Kaiser, Schleichstrasse 31, 8500 Nurnberg-Eibach, Fed. Rep. of Germany

[21] Appl. No.: 490,733

[22] Filed: May 3, 1983

Related U.S. Application Data

[63] Continuation of Ser. No. 177,819, Aug. 13, 1980, abandoned.

[51] Int. Cl.[3] ..... B60L 9/00

[52] U.S. Cl. ..... 191/10; 446/465; 446/484; 104/288

[58] Field of Search ..... 191/10; 46/235, 251, 46/257–261

[56] References Cited

U.S. PATENT DOCUMENTS

| | | | |
|---|---|---|---|
| 776,826 | 12/1904 | Caldwell . | |
| 2,638,347 | 5/1953 | Maggi . | |
| 3,206,891 | 9/1965 | Adamski | 46/235 |
| 3,403,272 | 9/1968 | Dold . | |

FOREIGN PATENT DOCUMENTS

| | | |
|---|---|---|
| 857019 | 11/1952 | Fed. Rep. of Germany . |
| 941659 | 4/1956 | Fed. Rep. of Germany . |
| 1067351 | 4/1960 | Fed. Rep. of Germany . |
| 1079516 | 4/1960 | Fed. Rep. of Germany . |
| 2055187 | 11/1970 | Fed. Rep. of Germany . |
| 1353598 | 6/1964 | France . |
| 746025 | 3/1956 | United Kingdom . |
| 979985 | 1/1965 | United Kingdom . |

*Primary Examiner*—Richard A. Schacher

*Attorney, Agent, or Firm*—Bacon & Thomas

[57] ABSTRACT

A combination of a track formed from sections which are joined one to another with articles such as toy vehicles for movement therealong is provided in which the power for movement of the articles is transmitted onto a magnet in the article from an electric magnetic field supplied to the track. The articles thus are moved without any electrical or mechanical contact with the track. Additional magnets are provided in the articles to provide steering and different speeds of movement of the articles and different frequencies may be induced simultaneously into the track separately to control different articles.

35 Claims, 33 Drawing Figures

Fig. 7
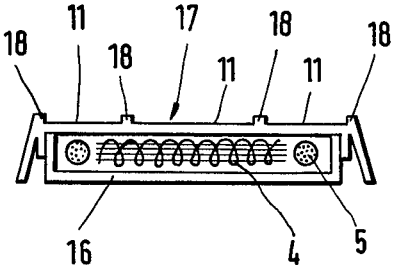
Fig. 8
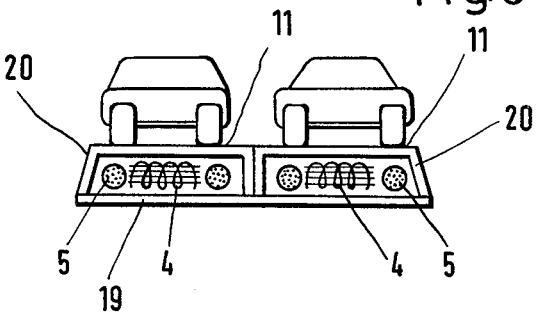
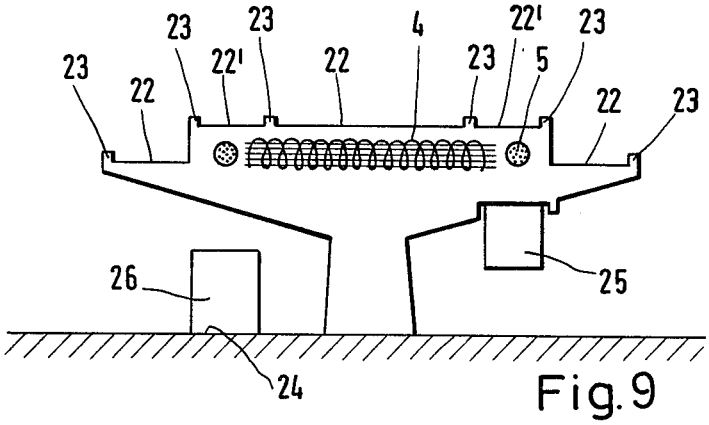
Fig. 9

Fig. 23
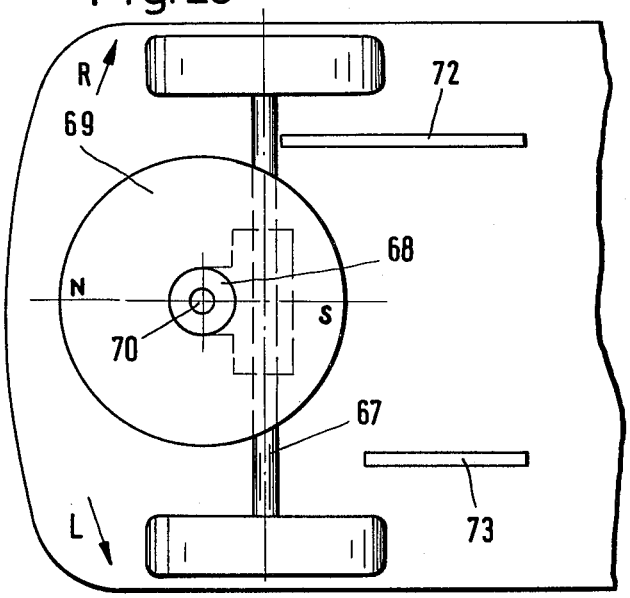
Fig. 25
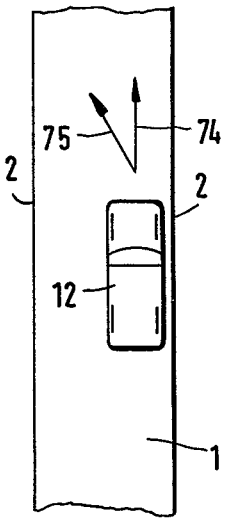
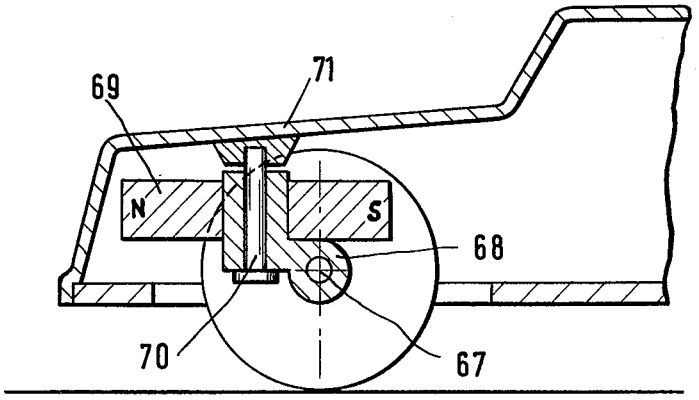
Fig. 24

APPARATUS COMPRISING A TRACK AND ARTICLES FOR MOVEMENT THEREALONG

This is a continuation of application Ser. No. 177,819 filed Aug. 13, 1980, now abandoned.

BACKGROUND OF THE INVENTION

It is true that toy installations in the form of a car track or the like, with the cars moving, and being guided, along the track, are known. With these, it is a disadvantage that for transmitting the driving force it is necessary to provide mechanical means, as for example by having a drive mandrel of the vehicle meshing with a rotating spiral located in a slot. Furthermore, an electric motor drive of the toy vehicles is known, wherein the track is provided with one or more electric rails in slots, or on top of the track, and current take-off collectors of the toy vehicles slide thereon. Here again, the considerable mechanical and/or electrical complexity is a disadvantage; it manifests itself both in a relatively high weight of the vehicles and in high manufacturing costs. In the case of tracks where the current is taken from rails by collectors it is a further disadvantage that the sparking which results causes noticeable interference with radio and television reception.

SUMMARY OF THE INVENTION

It is the object of this invention to provide a conveying installation with accessory articles, in particular a track installation with accessory toy vehicles, in which the drive energy is transmitted contactlessly, without it being necessary to provide a battery or a motor in the article which is to be conveyed.

To achieve this object the invention provides that at least one permanent magnet which rotates under the influence of the field is provided as a receiving component of the article to be conveyed, in particular of a toy vehicle or the like, and that a track which guides the article, in particular the toy vehicle or the like, and at the same time supplies it with the drive energy, and is equipped with a coil, or with a plurality of coils arranged in serially spaced relation along the track, for generating an alternating magnetic field. Such an article, in particular a toy vehicle, need not be equipped with a battery or with a motor. Rather, the receiving component, in the form of one or more rotating permanent magnets, can convert the energy transmitted to it by the alternating magnetic field directly, or via means of transmission, into the drive of the article. Thus, according to a preferred embodiment of the invention, one or more rotating permanent magnets may be in the form of a wheel or shaft of the toy vehicle. No devices for mechanical transmission of force from the track to the article to be conveyed are required, and furthermore no sliding contacts are required, thereby eliminating the disadvantages which have been described. This is also a precondition for being able to use articles devoid of a battery or of a motor, in particular toy vehicles of low weight and small size, since mechanical froce transmission, or the tapping of electrical current by collectors presupposes that the particular vehicle or article rests, with a certain weight, on the means of force transmission or on the electric rail. The manufacturing effort entailed for such a conveying installation, especially for a track installation with accessory toy vehicles or the like, is very low, and this correspondingly reduces the production costs. This is also assured by the fact that toy vehicles or the like, constructed according to the invention, can be very small. A further advantage of this small size—made possible by the invention—of such vehicles and hence of the accessory track is that the installation can also be set up in a relatively small space. With the track installations previously known, there was always the problem that they required a relatively large area for setting up, while such an area was frequently not available in the home. The track can be sub-divided into individual track elements which can be coupled together mechanically and electrically. Power transmission at relatively high efficiency is achieved, with very simple means, via a spray field. Furthermore, one track can simultaneously operate a plurality of drives, that is to say, a plurality of articles, in particular toy vehicles. A translatory and continuous conveying of the articles along the track is achieved by arranging an appropriate number of coils.

The speeds achieved can be widely varied by arranging different track sections side by side and by varying the frequency and other dimensions of the articles to be conveyed, in particular the diameters of the permanent magnets and of any means of force transmission.

Further advantages and features of the invention are to be found in the examples of embodiments which are described below and illustrated in the drawing, the said examples referring to the preferred possible embodiment of the invention, namely an educational aid and/or toy in the form of a track installation and accessory toy vehicles or the like.

BRIEF DESCRIPTION OF THE DRAWINGS

FIGS. 5–11 show further possible embodiments and tracks according to the invention;

FIGS. 23–25 show possible embodiments of controls according to the invention;

DESCRIPTION OF THE PREFERRED EMBODIMENTS

Figure 2:
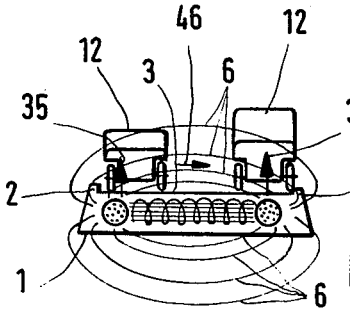
FIG. 2 shows a section along the line II—II in FIG. 1.
Figure 1:
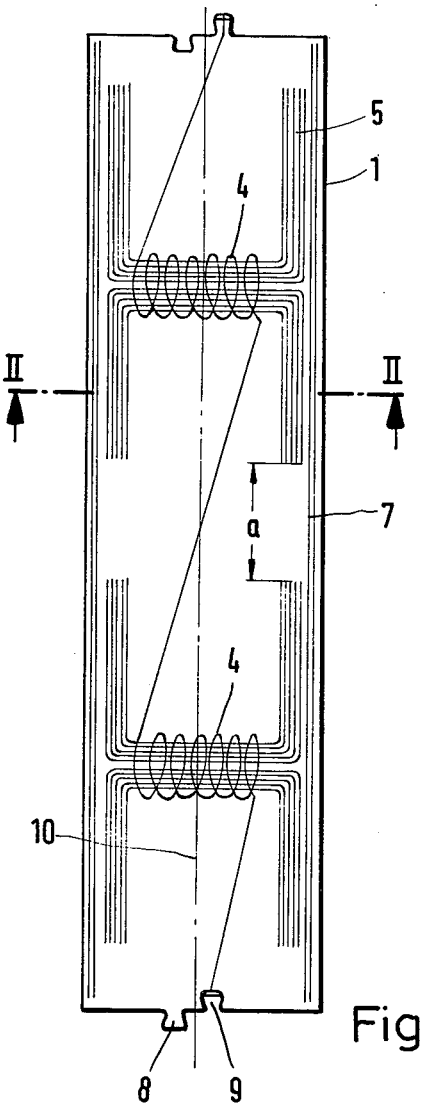
FIG. 1 shows a first exemplary embodiment of a track, in plan view, the track surface having been omitted.

First, the track or track installation in various exemplary embodiments will be explained. Thus, FIGS. 1 and 2 show track elements 1, which are made, for example, of plastic material and which have a predetermined length, the sides of which track elements can be provided with guide edges 2 for the vehicles. The track elements contain coils 4 which are wound around iron elements 5 and which therefore generate the stray field 6 electromagnetically (see FIG. 2). The iron component 5 in this exemplary embodiment consists of an appropriate number of bent wires, but the invention is not restricted to this arrangement. Further iron elements, for example, wires 7, can be inserted in the sides of the track elements 1 in order to bridge the gap a between the iron cores of the coils.

The track elements can be joined together, for example, in such a way that a projecting connecting element 8, similar to a snap fastener, is provided on each front page, together with a recess 9, which serves to receive the connecting element 8 of the adjacent track element and which broadens in the inward direction. Thus, the track elements can be connected at their front ends by means of a snap-fastening action, which at the same time also prevents the track elements from being twisted relative to one another about their longitudinal axis. The parts 8, 9 lie on either side of and symmetrically to the central longitudinal axis 10 of the track element.

The articles to be conveyed, in this case toy vehicles which are generally designated by 12, move along the running surface 3 of the track elements.

Figure 4:
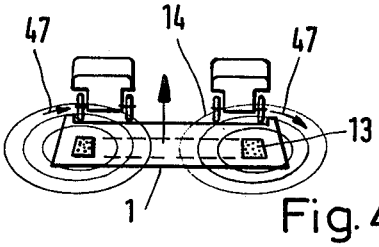
FIG. 4 shows a section along the line IV—IV in FIG. 3.
Figure 3:
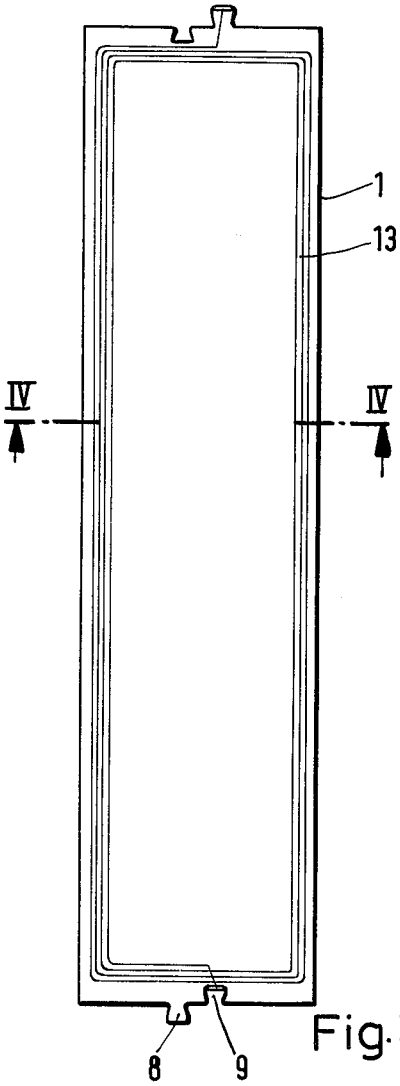
FIG. 3 shows a further exemplary embodiment of a track, the upper track surface again having been omitted.

In the exemplary embodiment in FIGS. 3 and 4, there is provided inside the housing 1, which is identical in this respect to the embodiment in FIGS. 1 and 2, an ironless copper coil 13 which, like the coils 4 connected in series in the embodiment in FIGS. 1 and 2, is electrically connected by the connecting means 8, 9 to the coils of the adjacent track elements so that in this case also, the parts 8, 9 serve as a means of providing not only mechanical coupling, but at the same time also electrical connection. The stray field 14 generated by the coil 13 is also illustrated in FIG. 4. As shown by a comparison with FIG. 2, the field runs differently from that in the embodiment in FIGS. 1 and 2 as a result of the different coil arrangement. The embodiment according to FIGS. 3 and 4 is intended particularly for the use of frequencies which are substantially higher than normal frequencies of, for example, 50 Hz.

Figure 5A:
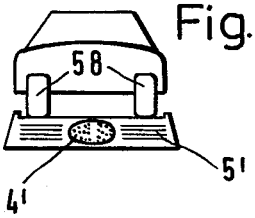
Figure 5:
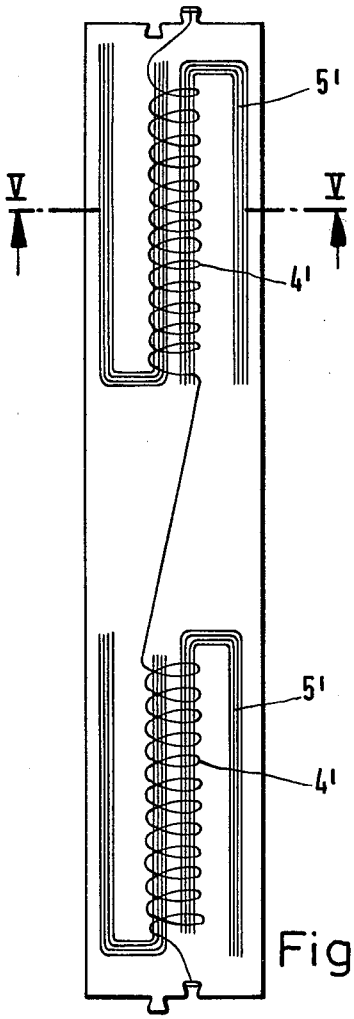

FIG. 5, together with the section V—V in FIG. 5*a*, shows a modification of the embodiment according to FIGS. 1 and 2, which is particularly suitable for narrower tracks. The coil runs in the longitudinal direction of the track and is designated by 4' and the iron elements by 5'.

Figure 6A:
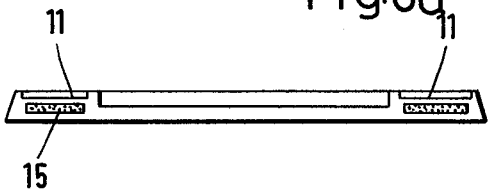
Figure 6:
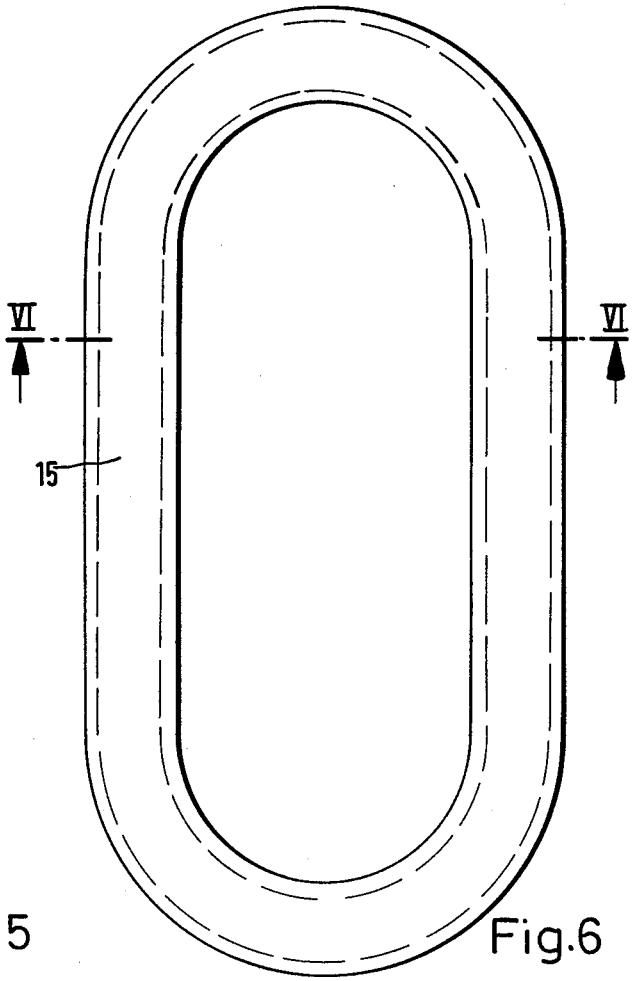

The exemplary embodiment according to FIGS. 6, 6*a* (section along the line VI—VI) shows a substantially flat, ironless winding 15, the relatively narrow track 11 being situated above the flat part of the coil.

FIG. 7 shows a two-part form of track element consisting of a lower part 16 and an upper part 17 which can be mounted thereon and which is, if necessary replaceable, the upper part 17 having a total of four guide ribs 18 with three tracks 11 for toy vehicles or the like which are to be conveyed. The coil 4 with iron elements 5 is approximately the same as in the exemplary embodiment in FIG. 1.

FIG. 8 shows a track having a lower part 19 and two upper parts 20 which form two running surfaces 11. In this case lateral guide webs are not provided since all the vehicles in this embodiment are retained in the track by the iron component of the coil (in this connection reference is also made to the subsequent explanation of the operation of the power transmission means according to the invention).

FIG. 9 shows a further possible embodiment of a track according to the invention, in the form of a "fly-over" with coils 4 and iron components 5 similar to the embodiment in FIGS. 1 and 2, a plurality of upper running surfaces 22, with guide webs 23, and also several lower running surfaces 24 for an overhead track 25 and a U-shaped track 26 being provided.

Figure 10:
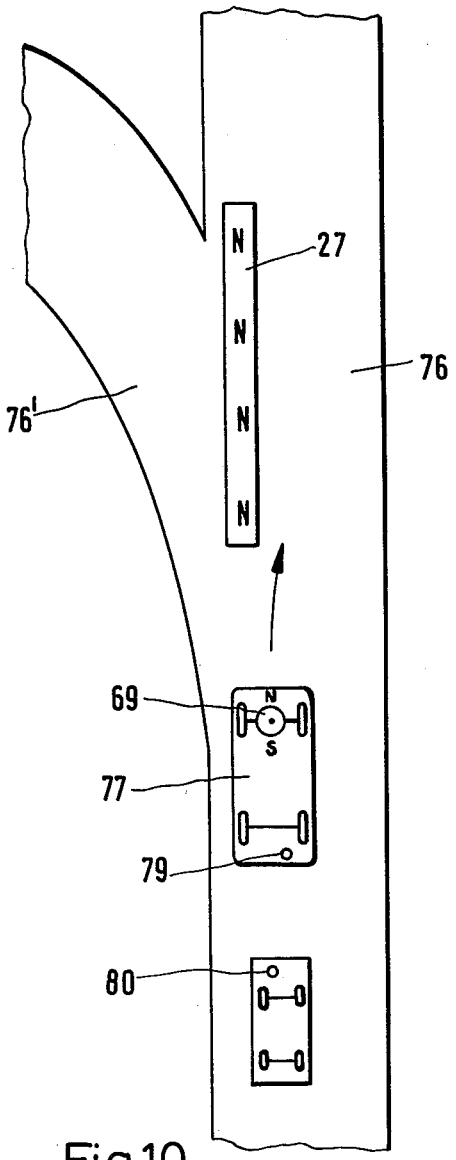
Figure 10A:
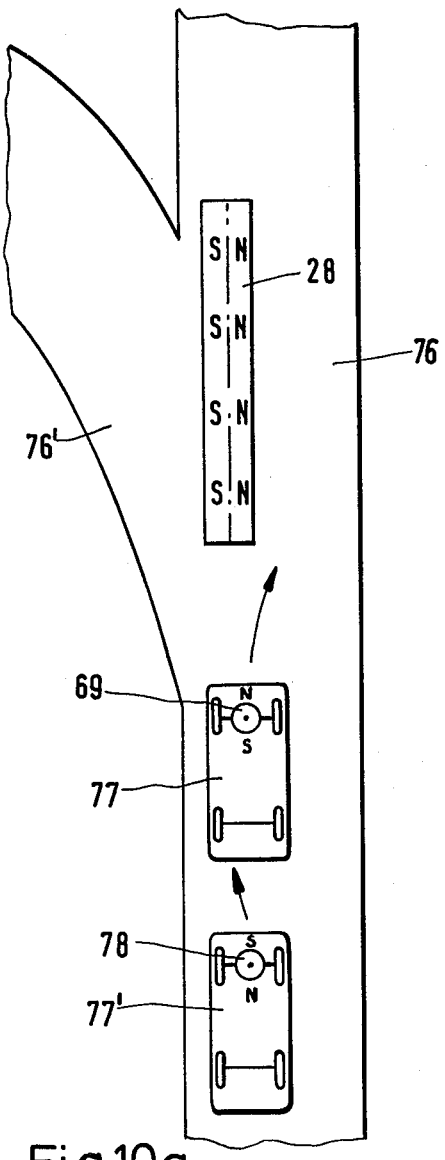
Figure 11:
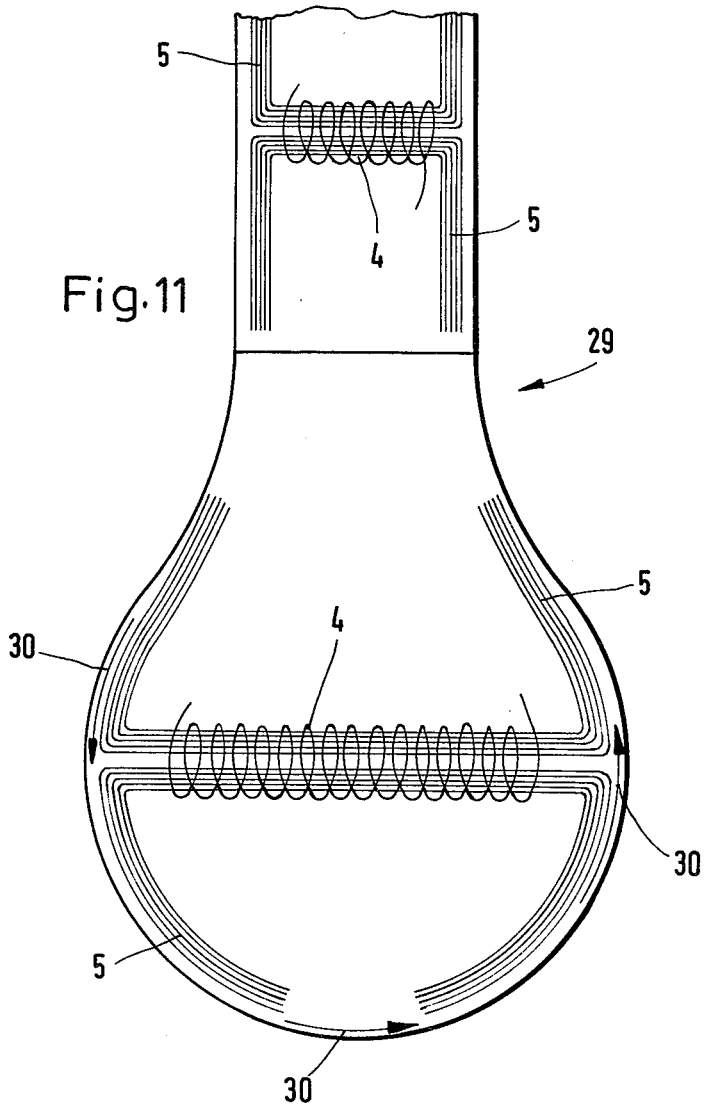

FIGS. 10 and 10*a* show, in plan view, track elements having points in the form of magnetized pivotable or fixed blades 27 with an upwardly directed pole and blades 28 with two upwardly directed poles, respectively. Particularly good guiding can also be obtained by using a 3-pole blade (not shown), while FIG. 11 shows a track element 29 comprising a winding 4 and iron components 5 approximately as shown in the exemplary embodiment in FIGS. 1 and 2, but with the track being in the form of a reversing loop (see arrows 30) for the vehicles or the like which are to be moved.

The mode of operation of this type of installation will be explained further on. First, examples of embodiments of the articles to be conveyed, in this case small toy vehicles, will be explained with reference to their construction and particularly to the arrangement and form of their permanent magnets.

While the track elements described, having the plurality of coils arranged in series and serving as electromagnetic stray field elements, have to a certain extent the characteristic of a stator, the vehicles described below possess, in their permanent magnets, the characteristic associated with the "rotor".

Figure 13:
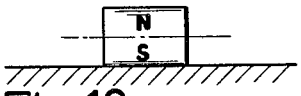
FIGS. 12–22 show possible embodiments of toy vehicles according to the invention.
Figure 14:
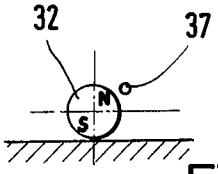
Figure 12:
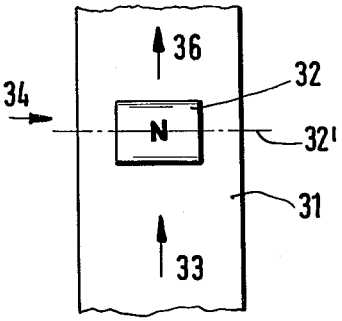

As an explanation of the principle of the invention, FIG. 12 shows, on a track indicated by 31, a permanent magnet 32 in the form of a cylinder, for example, a hard ferrite magnet, the diametrical polarity of which is indicated by N and S and can be seen in more detail from the front view in FIG. 13 (in the direction of arrow 33) and from the side view in FIG. 14 (in the direction of arrow 34). The longitudinal axis 32' of the magnet 32 extends parallel to the contact surface and at right angles to the direction of travel of the vehicle. A permanent magnet of this type is actuated by the field lines, emerging perpendicularly from the track surface, of the electromagnetic alternating field, as indicated by the arrows 35 in FIG. 2, the field lines always attracting or repelling the associated polarity in each case, thereby causing the permanent magnet to rotate and therefore causing the toy vehicle or the like, equipped with the magnet, to move in the direction of travel indicated by the arrow 36. In order to avoid a dead-center position, there is provided an iron piece 37 (see FIG. 14) which, for starting purposes, rotates the permanent magnet 32 so that the north pole N and the south pole S are not located exactly vertically above one another. A toy vehicle of this type can run, for example, on the surfaces 22' in the exemplary embodiment in FIG. 9.

Figure 15:
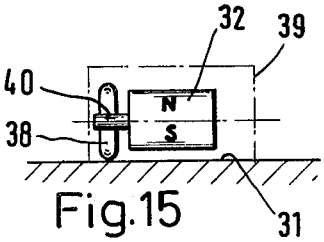

FIG. 15 shows diagrammatically the permanent magnet 32 according to FIGS. 12 to 14, with the associated track 31 and a friction wheel (not shown) which is driven by the permanent magnet and located on the axis thereof. The entire arrangement can be mounted in a housing 39 which is in this case indicated only by chain-dotted lines but which is intended to indicate a toy vehicle. A vehicle of this type moves perpendicularly to the plane of the drawing in FIG. 15. However, as shown in FIG. 15, the friction wheel could also be driven in such a way that an axle stub 40, which is attached to the permanent magnet in an extension of the magnet axis, drives the correspondingly larger friction wheel 38. As a result of this reduction ratio, the speed of the vehicle is reduced correspondingly.

It follows from the preceding description that the electromagnetic alternating field must have a component perpendicular to the longitudinal axis of the magnet.

Figure 16:
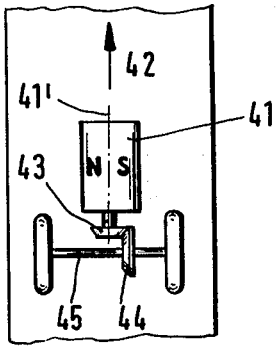

In the exemplary embodiment in FIG. 16, the longitudinal axis 41' of the permanent magnet 41 extends in the direction of travel indicated by the arrow 42. An axle stub 43 of the permanent magnet drives a crown wheel 44 of the wheel axle 45. A toy vehicle or the like, equipped with such a permanent magnet 41, will have to be fitted on a section of the track over which the magnetic field lines extend completely or partially perpendicularly or at right angles to the direction of travel, for example, in the area 46 of the field lines according to FIG. 2 or in the area 47 of the field lines in FIG. 4. The gearing 43, 44 could also be replaced by a "magnetic toothed rack" (see FIGS. 28 and 29).

Figure 18:
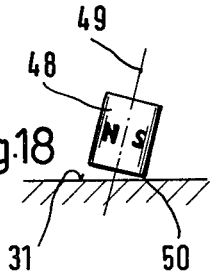
Figure 19:
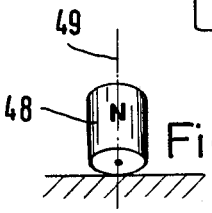
Figure 17:
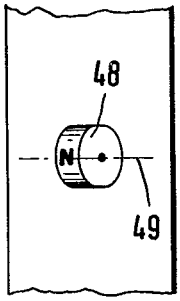
Figure 20:
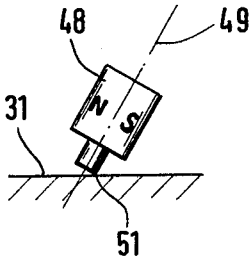

A permanent magnet 48 having an inclined axis 49 is shown in the example in FIG. 17 (plan view), in FIG. 18 (front view) and in FIG. 19 (side view). A vehicle which is equipped with a permanent magnet of this type can run on track sections which are crossed by approximately vertical magnetic field lines, as well as on track sections above which the magnetic field lines extend approximately horizontally, since as a result of the inclined position of its axis the permanent magnet is caused to rotate by vertical field lines and by horizontal field lines of an alternating field. The output is obtained directly by the edge 50 running on the track 31. In the modification of this embodiment shown in FIG. 20, the permanent magnet 48 rotates with the edge of a crowned axle stub 51 on the track 31, thereby producing a reduction ratio which can be varied by pivoting the axle.

It follows from the preceding description, together with the explanation of the various embodiments of tracks, that, by arranging the permanent magnet or magnets in the article to be conveyed, in this case a toy vehicle or the like, it is possible, if necessary, to determine on which track section or the strip-shaped section of the track the article is to continue moving. If, for example, a track as shown in FIGS. 1 and 2 is taken as a basis, toy vehicles or the like having permanent magnets arranged as in FIGS. 12 to 15 would move along the edge of the track, where the vertical field lines occur. A toy vehicle or the like having permanent magnets arranged as in FIG. 16 would, in addition, be able to run in the centre of the track, where the horizontal field lines occur, while a toy vehicle or the like having a permanet magnet arranged as in FIGS. 17–19 would be able to run both along the right edge and in the center of the track.

Figure 21:
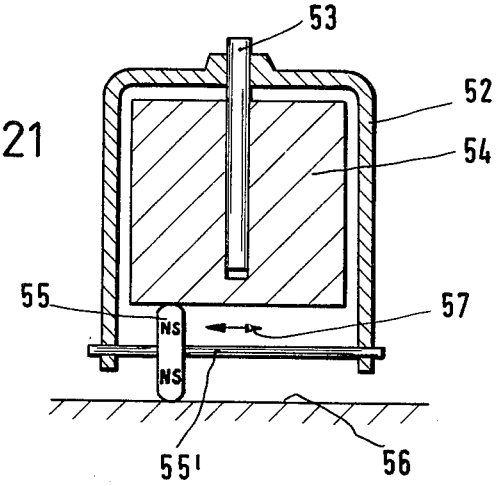

FIG. 21 shows, inside a vehicle body 52 which in this case is only indicated diagrammatically, a permanent magnet 54, which is mounted in the vehicle body by means of the axle 53 and the rotary motion of which is transmitted to a friction wheel 55 and, from there, to the running surface 56, whereby the vehicle is moved in the direction of travel perpendicular to the plane of the drawing. The friction wheel 55 can be moved back and forth on an axle 55' in the directions of the arrows 57, thereby making the transmission ratio and also the direction of travel infinitely variable. The wheel 55 can be displaced along the axle 55' by external means (not shown), for example, by magnetic control. By rotating the entire arrangement about a vertical axis, it is possible for the vehicle to be steered.

It is obvious that each vehicle can be provided with one or more permanent magnets. A particularly advantageous embodiment is that of the permanent magnets in the form of a wheel cylinder or wheels of a toy vehicle or the like as in the principle of the arrangement shown in FIGS. 12–15. This embodiment is distinguished by its simplicity of design in which only a very small body, for a vehicle or the like, needs to be provided and to be equipped with the permanent magnets which are at the same time in the form of wheels. Thus, for example, FIG. 5*a* shows a vehicle body having two permanent magnets 58, acting as wheels, which are influenced by the magnetic field lines extending approximately vertically from the iron elements 5'. The vehicles illustrated in FIGS. 2 and 4 are also to be operated in the same way.

Figure 22:
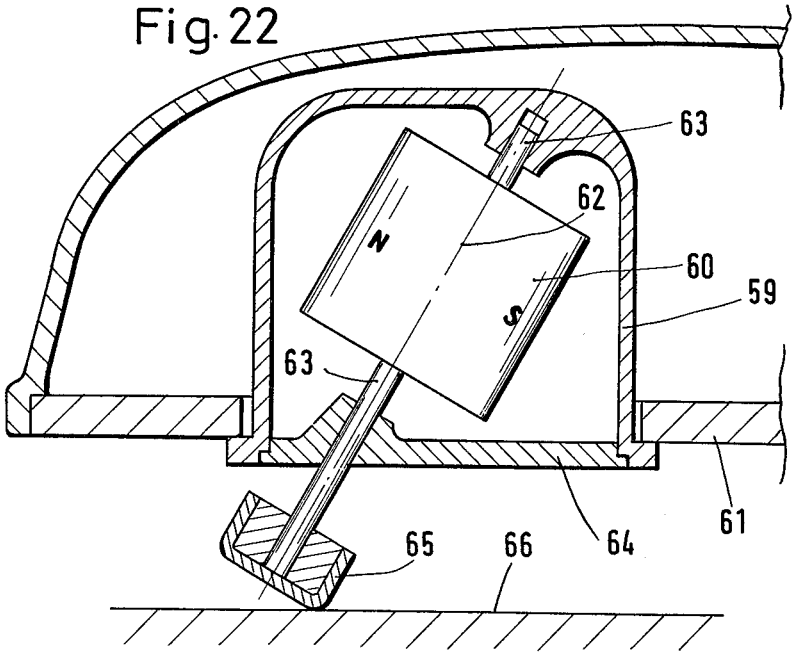

FIG. 22 shows how a body 59 comprising a permanent magnet 60 can be inserted in an opening in the vehicle floor 61. This can be done by means of a so-called "buttoning in" operation employing a click-in or snap-fastening action (not shown in detail). In an extension of the longitudinal axis 62 of the magnet there are provided axle stubs 63 which are mounted in the body 59 and in the body floor 64, respectively. The lower axle stub 63 ends in an interchangeable friction wheel 65 which runs along the track surface 66 and thereby drives the vehicle. The same arrangement can be used similarly to actuate a steering lock. In this connection particular reference is made to the observations below.

FIG. 23 shows in plan view and FIG. 24 shows in an associated longitudinal section how the means of force transmission according to the invention can also be used for steering. The wheelshaft 67 is non-rotatably connected by an intermediate part 68, made, for example, of plastic material, to a permanent magnet 69, which, like the other permanent magnets, is magnetized diametrically (N-S). The arrangement described above is pivotably mounted in the vehicle body 71 by a central pivot 70. A magnetic pulse, which is superposed on the alternating magnetic field and which rotates the permanent magnet 69 either to the left or to the right, is generated by an appropriately polarized direct current component in the coils of the track, hereby pivoting the wheelshaft 67 correspondingly. This pivoting movement can be limited by interchangeable stops 72, 73. In the present example, the stops are designed in such a way that the axle can be pivoted to the left, that is, in the direction (L) of the arrow, but not to the right (arrow direction R) since in this case the stop rests against the front edge of the stop 72. As shown in FIG. 25, the arrangement can now be operated in such a way that the vehicle (for example, numeral 12) running on the track (for example, numeral 1) is steered slightly to the right so that it normally always travels along the right guide edge 2 (see direction of travel according to arrow 74). A direct current causes the axle 67 to pivot to the left so that the vehicle moves in the direction of arrow 75 as far as the opposite guide edge 2, on the left side of FIG. 25, of the track and then slides along the said guide edge. By using a direct current in the opposite direction or by omitting the direct current, the previous steering turn can be repeated so that, as a result of the predetermined turn to the right, the vehicle moves again towards the guide edge 2 on the right in FIG. 25. A second vehicle is provided with permanent magnets 69 having opposite polarity and its steering is only deflected when a direct current of opposite polarity is generated. Thus, two vehicles can be steered independently of one another. However, the second alternative, instead of steering a second vehicle, can also be used in the same vehicle to actuate the gear-shift control means or stepping relays.

With other vehicles, the arrangement can be reversed, i.e., the stops 73 and 72 are changed over and the vehicle has a slight steer to the left when running in a straight line. Then the vehicle moves first along the left guide edge and, after a direct current is generated, it moves towards the right guide edge. Thus, overtaking operations are possible.

The magnetic points arrangement according to FIGS. 10, 10*a* also becomes evident from the preceding description of FIGS. 23–25. In the exemplary embodiment in FIG. 10, a switch blade 27, which is, if necessary, movable and which has upwardly directed north poles, is provided below the track 76. An approaching vehicle 77 with permanent magnets 69 diametrically magnetized N-S is steered to the right, if its part which has N polarity is situated to the right of the switch blade when approaching the latter, since in this case repulsion takes place at the N poles of the blade 27. The vehicle can be diverted into the branch 76' of the track if it has been previously steered towards the left guide edge of the track 76, as the repulsion of the N poles then causes a steering turn to the left. The stops for limiting the pivoting movement to the left are to be arranged according to the desired or possible steering turns. An appropriately polarized guide magnet 80 of a vehicle 77 which is not provided with separate steering is influenced correspondingly by the switch blade 27. If a magnet 79, which has the same polarity as the magnet 80, is provided at the rear of the preceding vehicle, the said magnet 79 being staggered slightly to the right from the center line and the magnet 80 being staggered slightly to the left from the center line, the two magnets operate in the manner of an automatic overtaking system when the rear vehicle approaches the front vehicle, the vehicle approaching from the rear being automatically diverted to the left.

In the example in FIG. 10*a*, vehicles which are designated by reference numeral 77 and have permanent magnets 69, with their north poles situated at the front and their south poles at the rear, and a magnetic switch blade 28 provided on the left with south poles and on the right with north poles, are steered differently from vehicles 77' in which the S pole is situated at the front of and the N pole at the rear of the permanent magnet 78.

There can also be provided a 3-pole switch blade which has N poles, for example, in the center, and a strip with S poles on both the left and right sides (not shown). This results in a particularly precise guiding, for example, of the magnet pin or stud 80, the ends of which are provided with the poles.

Moreover, the steering magnets 69 can be rotated through 180° by the operator so that the steering characteristics of this vehicle relative to the track are correspondingly reversed.

Figure 26:
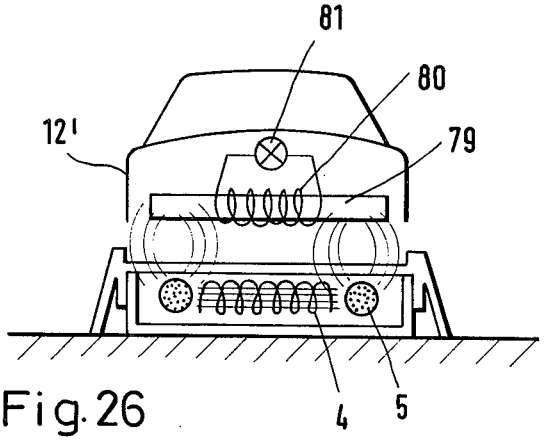
FIG. 26 shows a further embodiment of the invention, for operating a light-emitting system.

According to FIG. 26, the stray field effect of the coils 4 can also be used, by way of a soft ferrite core or the like 79 and a coil 80, to create lighting, in particular by using light-emitting diodes (LED) 81.

Figure 27:
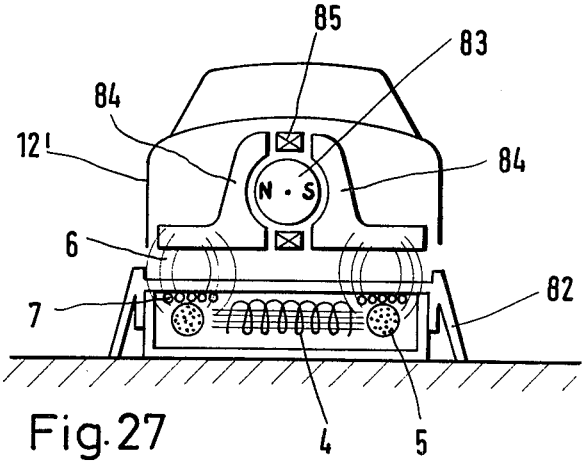
FIG. 27 shows a further possible embodiment of the invention.

A further exemplary embodiment of the invention is illustrated in FIG. 27. A coil 4 having iron components 5 and additional iron wires or the like 7 is situated in a track 82. Iron elements/ferrites 84, which collect the magnetic stray field 6 and conduct it to the permanent magnet 83, are situated in the vehicle 12'. The permanent magnet can induce a winding 85 which operates a light-emitting system. A combination, to a certain degree, of the stray flux and the power supply to the permanent magnet and therefore an increase in efficiency are achieved in this case so that such an arrangement is recommended particularly for high-speed racing cars and the like.

It is obvious that not only imitations of motor vehicles, but also those of helicopters, ships and the like can be provided as the vehicles. Motorcycles can also be allowed to run on this type of track as long as the magnetic wheels driving said motorcycles have sufficiently wide contact surfaces and run over tracks in which they are supported by the attraction of the iron conductors situated below. The motorcycle is hereby prevented from overturning.

The means of power transmission should be designed in such a way that the torque produced by the permanent magnets is greater than the friction torque to the track in order that, following a collision and resulting stoppage of the vehicle, it may be possible for the vehicles to be re-started and to move around the track. An increase in the frequency of the alternating field, for example, by a frequency generator, results in a correspondingly greater transformer effect, and also in a correspondingly higher rotational speed for each permanent magnet. If several series of coils are situated next to one another in a track, each series being electrically independent of the other series, the vehicles or the like running on a series of coils can be accelerated by varying the frequency of the said series, for example, when a vehicle of the other series of coils is to be overtaken. Therefore, groups consisting of several vehicles can be provided in each case, it being possible for one group to be operated independently of the other groups. In this case the possible methods of overtaking as explained are considerably facilitated by the fact that the vehicles have no contacts. While a speed of 5 km/hour is achieved with one group of vehicles, for example, at a frequency of 50 Hz and depending on the design of the vehicle parts, it is possible for another group of vehicles to run at a correspondingly higher speed as a result of the abovementioned increase in frequency. Several frequencies can also be used at the same time on the same track since, as is generally known, there is no mutual interference between these frequencies during superposition. In this case, each of the rotors is to be synchronized with its frequency during starting. In this case it would be advisable for the vehicles to be started by using at first the higher operating frequency. The vehicles, when running, only require a speed range ratio of, for example, 1:2. The vehicles would therefore operate at:

| | |
|---|---|
| 0–50 Hz—within a wide range | (1) |
| 70–150 Hz | (2) |
| 180–350 Hz | (3) |

etc. Their speeds do not have to be completely different because it would be possible to compensate for different speeds with different reduction ratios. Moreover, because of the power increase proportional to frequency, it is sufficient to use smaller magnets for vehicles operated at higher frequencies.

Figure 28:
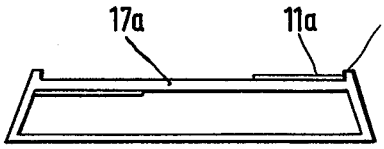
FIGS. 28–30 show further exemplary embodiments of the invention.
Figure 29:
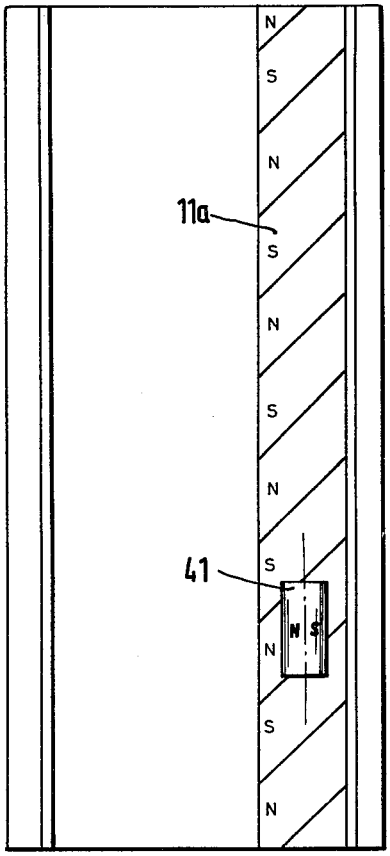
Figure 30:
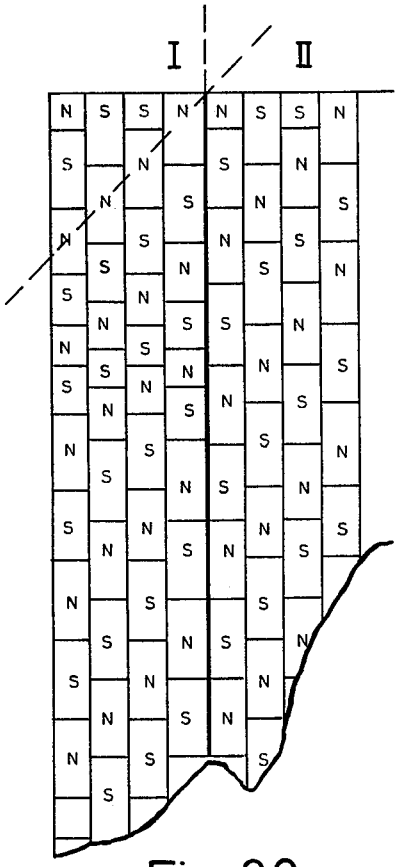

The exemplary embodiment of FIGS. 28–30 shows, in addition to the coils (which are not shown in these figures), a permanent magnet strip 11*a* which alternates between N and S polarity. In this connection the lines separating the magnetic elements with N polarity and the magnetic elements with S polarity run diagonally, i.e., at an acute angle to the direction of travel. This can be achieved either by correspondingly shaped magnetic strips with diagonal side edges, as in the example of FIG. 29, or by providing a plurality of longitudinal magnetic strips having individual N-S rectangular pieces which are staggered relative to one another, as shown in the example of FIG. 30. Depending on the position of its poles, a permanent magnet 41, which is caused to rotate by the alternating field of the coil, is drawn either forwards or backwards along the permanent magnet strip 11*a* and moves along, as it were, a "magnetic toothed rack" on this strip. The mechanical means of transmitting force from the magnet to the track is hereby replaced by a magnetic means of force transmission. It is obvious that, when the magnet, for example, rotates clockwise about its longitudinal axis, it is moved forwards and, when it rotates anticlockwise, it moves backwards, or vice versa. In this case the longitudinal axis of the permanent magnet should have at least one component parallel to the track. The magnetic strip 11*a* can be bonded to the track 18 (FIG. 28, right-hand side) or can be situated below the said track (FIG. 28, left-hand side).

By reducing the distance between the poles in the magnetic strip (see the upper third of FIG. 30), it is possible to reduce the speed of the vehicle.

In the vehicle, there can also be provided another magnet which serves as a servomotor for operating a blinker, a gear-change or the like and which can be operated either by a separate frequency, particularly a low frequency, or even by the permanent magnets of the magnetic strip 11*a*. It can therefore also be used to achieve a starting action when such a vehicle is moved over magnet strips of this type.

The features which are described in one exemplary embodiment, and combinations of features can be used accordingly also in other exemplary embodiments, and vice versa. All the illustrated and described features and combinations of features are to be considered part of the invention.

The use of this invention to steer an article of the type described herein independently of the propelling system used to drive the article along the track is considered as being fully within the scope of the invention. Thus, the inventive concept includes steering an article using the electromagnet system herein disclosed even though the article is propelled in a conventional manner by a small electric or gasoline motor.

I claim:

1. Apparatus for transporting and guiding movable articles such as toy vehicles comprising a longitudinal track having a track surface and at least one coil means associated with said track arranged to be energized and to generate an alternating magnetic field having at least a component vertically intersecting the track surface; a movable article arranged to be transported along the track surface; at least one permanent magnet carried and supported by the article so that it is fully rotatable about a rotational axis, the magnet being configured in the form of a shaft or disc (i.e., a short shaft) having a longitudinal axis coinciding with its rotational axis, with the magnet poles comprising diametrically opposed contiguous portions of the shaft or disc located on opposite sides of the axis of revolution, said magnet further being supported by the article so that the magnet is fully rotated by at least the vertical component of the alternating magnetic field when the article is oriented on the track surface for movement therealong.

2. Apparatus as claimed in claim 1, including means for generating an alternating magnetic field having a component extending transversely relative to the track surface, said at least one magnet being disposed so as to be influenced in a rotational sense about its rotational axis by either and both the vertical and transverse magnetic fields.

3. Apparatus according to claim 1 or 2, wherein the track comprises a plurality of track elements which have at least one coil and which can be electrically and mechanically connected.

4. Apparatus according to claim 1 or 2, comprising a plurality of track sections which are electromagnetically independent of one another are provided side by side and are combined in a single track element.

5. Apparatus according to claim 4, comprising means, in one of the tracks and the article, for varying the speed of movement of the article.

6. Apparatus according to claim 5, wherein the means for varying speed comprises one of: means for varying the frequency of the alternating current, the transmission ratio, the reduction ratio between the permanent magnetic and article drive to the track, or a strip having variably spaced permanent magnets.

7. Apparatus according to claim 5, wherein the connection between the track elements comprises snap fastener-like projections and recesses which receive the said projections with a snap-engaging action, the parts being provided on both ends of a track element and arranged on both sides and symmetrically with the central longitudinal axis of the track elements, so as to hold the track elements firmly together by means of a slight pretensioning.

8. Apparatus according to claim 3, wherein the track elements are provided with lateral guide edges for the vehicle.

9. Apparatus according to claim 1 wherein the coil means are reinforced by iron inserts, for example, approximately U-shaped wires or the like.

10. Apparatus according to claim 9, wherein the coil means run at right angles to the conveying direction and parallel to the running surface of the track.

11. Apparatus according to claim 3, comprising an ironless coil, particularly a flat copper coil in a track element.

12. Apparatus according to claim 8, wherein the track elements consist of an upper part and a lower part, connected to enclose, between them, the coils and, iron inserts of the coils, and the upper part defines the running surfaces and the guide edges.

13. Apparatus according to claim 3, comprising track elements in the form of a reversing loop having a guide edge provided at least on the outside.

14. Apparatus according to claim 3, comprising track elements having strips with a predetermined magnetic polarity, which strips serve as a "switch blade", provided below the running surface and are optionally pivotable, and with corresponding permanent magnets being provided in the vehicle.

15. Apparatus according to claim 1, including an iron piece provided near the circumference of the permanent magnet in such a manner that it attracts one of the poles so that both poles of the permanent magnet are situated in a starting position, from standstill, which can be operated by the alternating magnetic field, the iron piece being also adaptable for the purpose of obtaining another direction of rotation.

16. Apparatus according to claim 1 wherein the rotational axis of the permanent magnet extends parallel to the track and at right angles to the direction of movement of the article.

17. Apparatus according to claim 1 wherein the rotational axis of the permanent magnet extends in the direction of movement of the article, and that the associated track portion is situated below the magnetic field lines which include a component extending approximately horizontally to the running surface and at right angles to the direction of movement.

18. Apparatus according to claim 1 wherein the rotational axis of the permanent magnet extends at an angle to the track surface, the projection of the said axis onto the track surface extending transversely in a plane lying at right angles to the direction of movement of said article.

19. Apparatus according to claim 1, wherein said permanent magnet includes a friction wheel transmission and is enclosed in a housing removably secured, for example by a snap fastener, to the floor of said article.

20. Apparatus according to claim 1, including a friction wheel for transmitting the torque, produced by the permanent magnet, to the running surface of the track, said transmission ratio or reduction ratio of the friction wheel being variable.

21. Apparatus according to claim 1, wherein several frequencies of different magnitude are used at the same time on the same track, and the articles have different drive ratios.

22. Apparatus according to claim 1 including a coil on the article, which is connected to a light source, whereby a current can be induced in said coil by the stray field of the track to illuminate said light source.

23. Apparatus according to claim 22, including a ferromagnetic material located in the article and which forms a magnetic conductor from the stray field to the permanent magnet.

24. Apparatus according to claim 1, including an additional attachment of a magnetic strip on said track having permanent magnet pieces alternating between N polarity and S polarity, the effective line separating the two polarities running at an acute angle to the direction of travel and the longitudinal axis of the associated permanent magnet of the article having at least one component running parallel to the track.

25. Apparatus according to claim 24, wherein, in one direction in which the permanent magnet strip extends, the dimensions of the permanent magnet pieces are smaller over part of the area of the magnetic strip than over the remaining area thereof.

26. Apparatus according to claim 1 wherein a magnetic rod or the like is provided in the rear of one of said articles and in the front of an article located behind said one article and in which the said magnetic rods are staggered relative to one another on opposite sides of the central lines.

27. Apparatus according to claim 1, including a further magnet in the article, which magnet serves as a servomotor for operating a blinker, or a gear.

28. Apparatus as claimed in claim 1 or 2, said at least one magnet being arranged to propel said article along the track when rotated.

29. Apparatus as claimed in claim 1 or 2, including means for generating a unidirectional magnetic field in the area of the track, said article including directional steering means, and an additional moveable permanent magnet carried by said article, said additional magnet being moveable by said unidirectional magnetic field to effect actuation of said directional steering means.

30. Apparatus according to claim 29 including stops for limiting the steering turns of said additional magnet in both steering directions.

31. Apparatus according to claim 30, including permanent magnets on said track for generating said unidirectional magnetic field and, by a guide magnet on the article having a polarity (N-S) responsive to the polarity of a magnetic switch blade.

32. Apparatus according to claim 31, wherein the permanent magnet for the steering can be pivoted through 180° about its axis.

33. Apparatus according to claim 31, including a second article having a permanent magnet of opposite polarity to that of the first article.

34. Apparatus according to claim 31, wherein one of said articles is provided with a control magnet, having an opposite polarity to that of the steering magnet, for actuating one of a gear-shift control mechanism and a stepping relay.

35. Apparatus according to claim 1, wherein said magnet is a cylinder of revolution.

* * * * *